US005713594A

United States Patent [19]

Jenni

[11] Patent Number: 5,713,594

[45] Date of Patent: Feb. 3, 1998

[54] SNOW BOARD BINDING

[76] Inventor: David Christian Jenni, 11808 Darlington Ave. Apt. 1, Los Angeles, Calif. 90049

[21] Appl. No.: 683,214

[22] Filed: Jul. 18, 1996

[51] Int. Cl.[6] ..... A63C 9/08

[52] U.S. Cl. ..... 280/624; 280/14.2

[58] Field of Search ..... 280/611, 613, 280/623, 624, 626, 631, 632, 634, 14.2

[56] References Cited

U.S. PATENT DOCUMENTS

| | | | |
|---|---|---|---|
| Re. 33,544 | 2/1991 | Dennis | 280/618 |
| 3,173,701 | 3/1965 | Beyl | 280/17.35 |
| 4,465,295 | 8/1984 | Spademan | 280/624 |
| 4,600,214 | 7/1986 | Spademan | 280/624 |
| 4,973,073 | 11/1990 | Raines | 280/624 |
| 5,035,443 | 7/1991 | Kincheloe | 280/618 |
| 5,190,311 | 3/1993 | Carpenter | 280/14.2 |
| 5,299,823 | 4/1994 | Glaser | 280/625 |
| 5,503,414 | 4/1996 | Teeter | 280/14.2 |
| 5,505,478 | 4/1996 | Napoliello | 280/14.2 |

OTHER PUBLICATIONS

K2 Snowboards Sales Catalogue pp. 18419 Fall Winter 1995–1996.

*Primary Examiner*—Richard M. Camby
*Attorney, Agent, or Firm*—Ronald M. Goldman

[57] ABSTRACT

An easy to use snow board binding automatically locks a rider's boot in place on the snow board. By inserting an end of the boot plate into the binding's socket and pivoting the other end down, the boot plate rotates an actuator arm, that pivots a spring loaded latch mechanism, which moves into a latched position. That action also moves a keeper arm to block removal of the boot plate, thereby locking the boot plate in place. The binding is unlatched manually by forcing the spring loaded latch mechanism back to the unlatched position. Any mechanical moment produced by forcing the boot plate against the keeper arm, however, is insufficient to unlatch the binding.

17 Claims, 4 Drawing Sheets

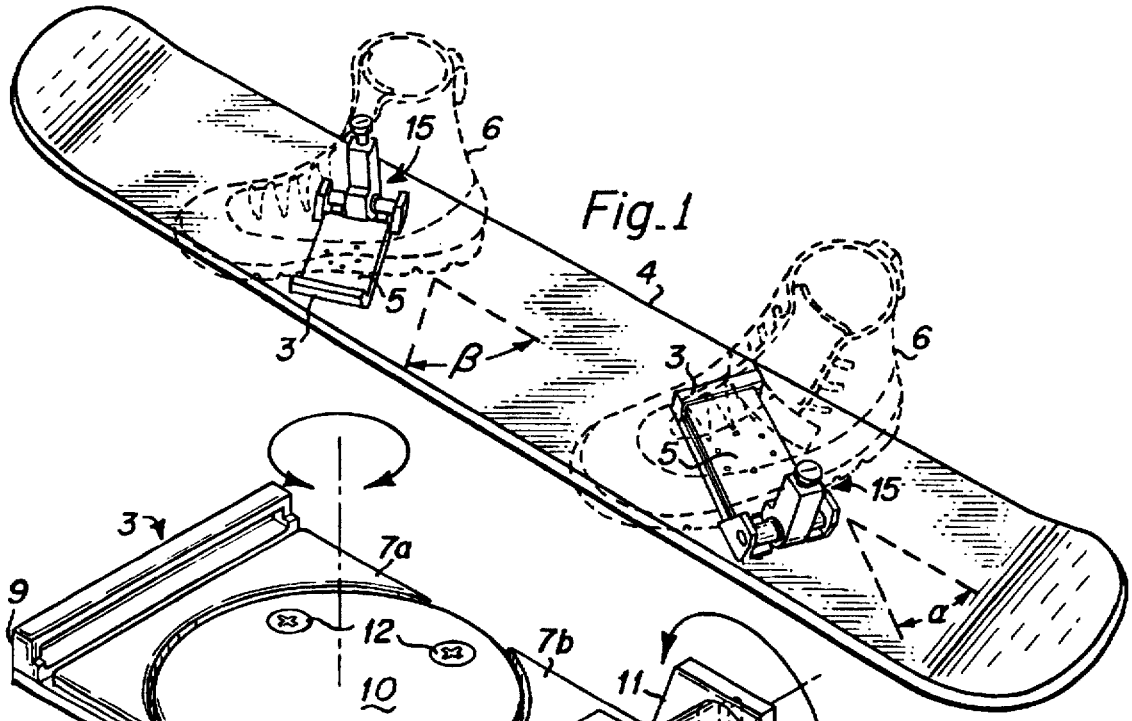
Fig_1
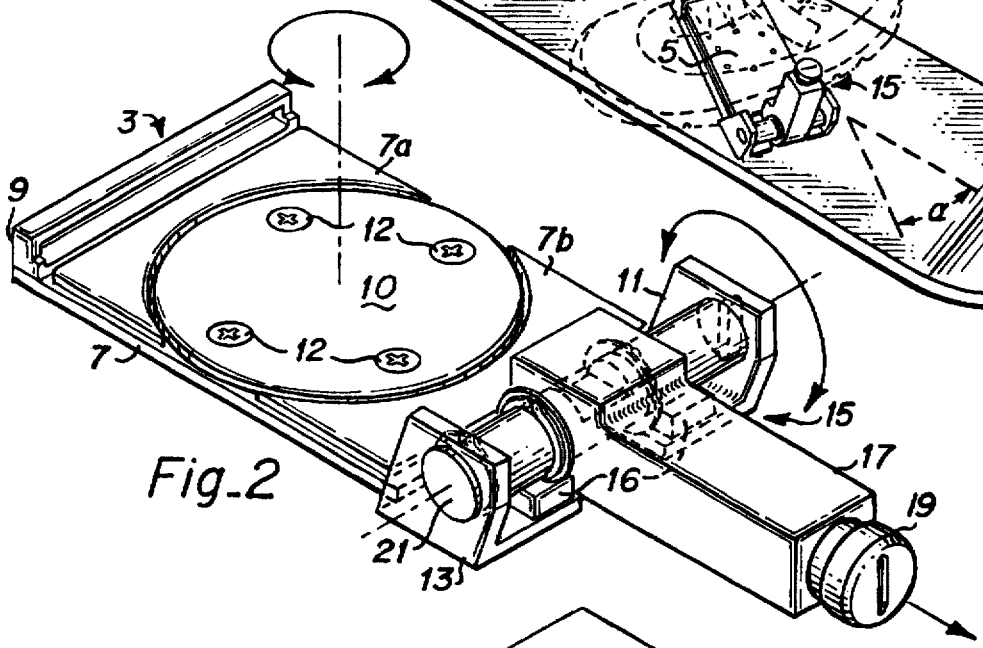
Fig_2
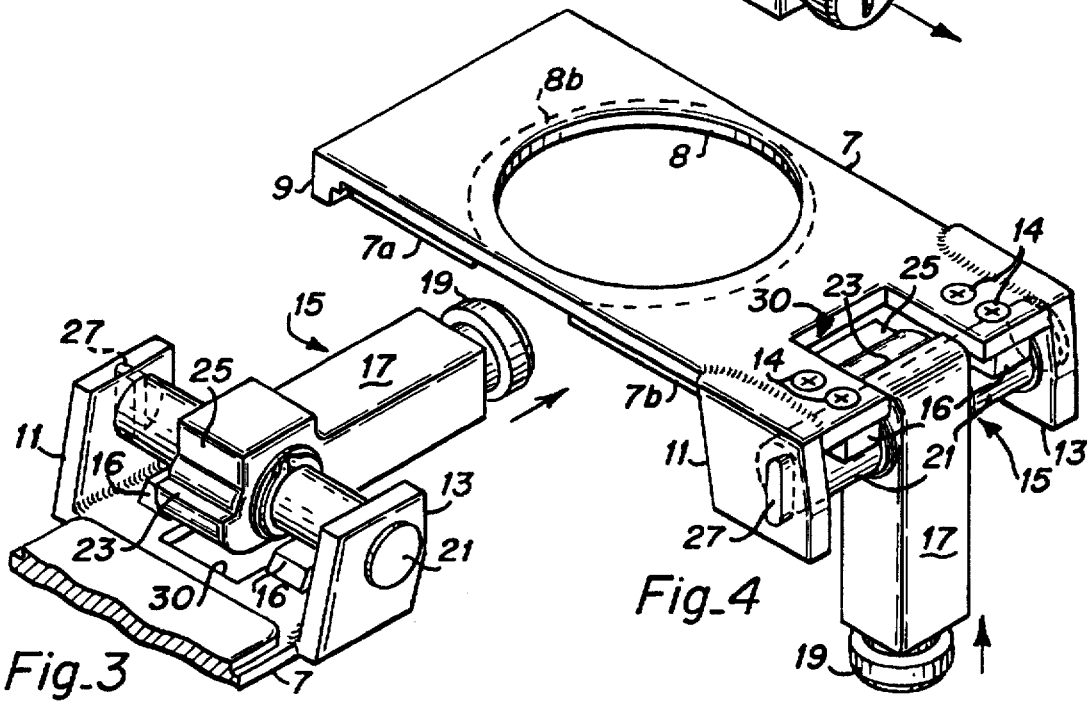
Fig_3
Fig_4

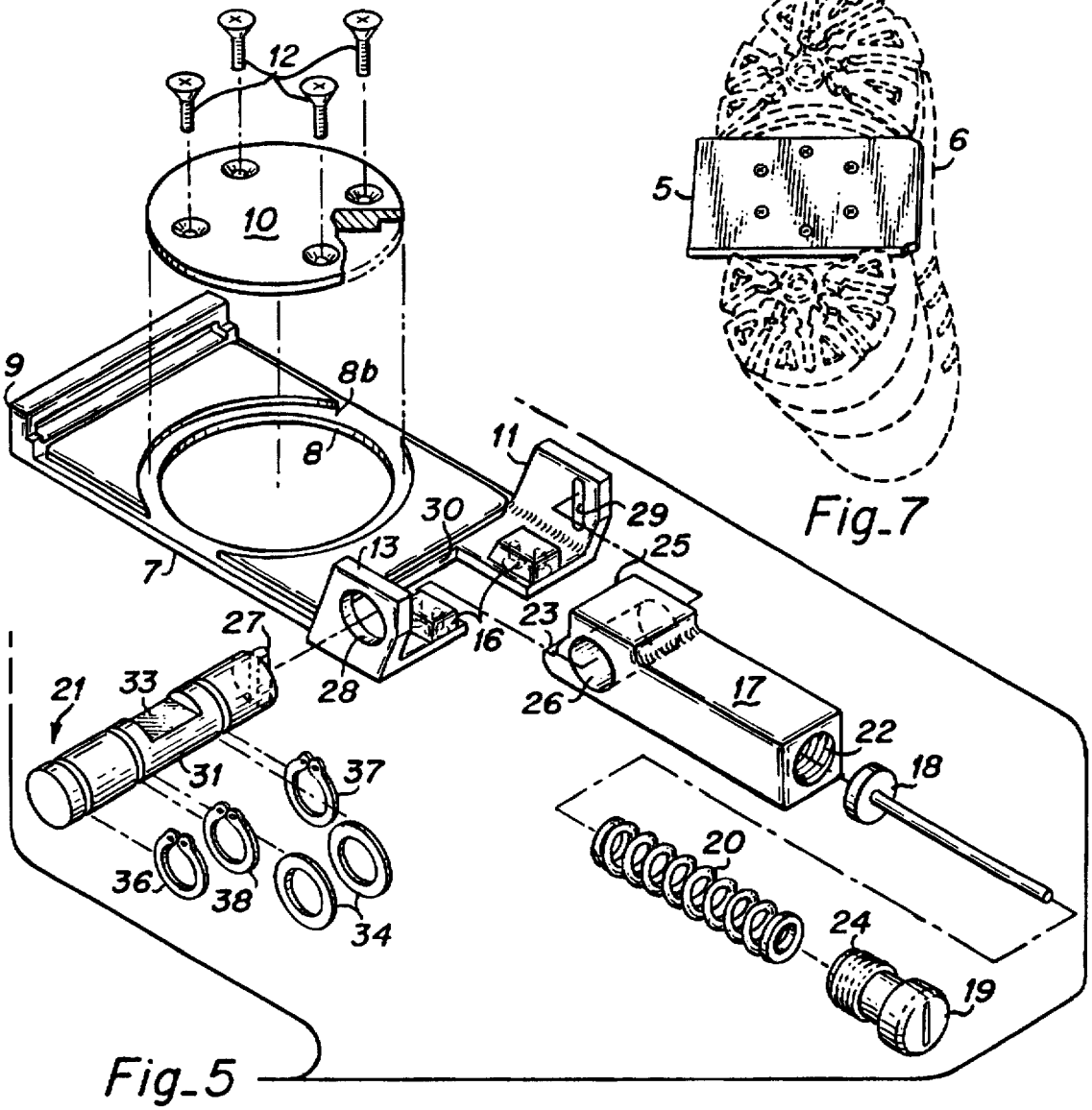
Fig_5
Fig_7
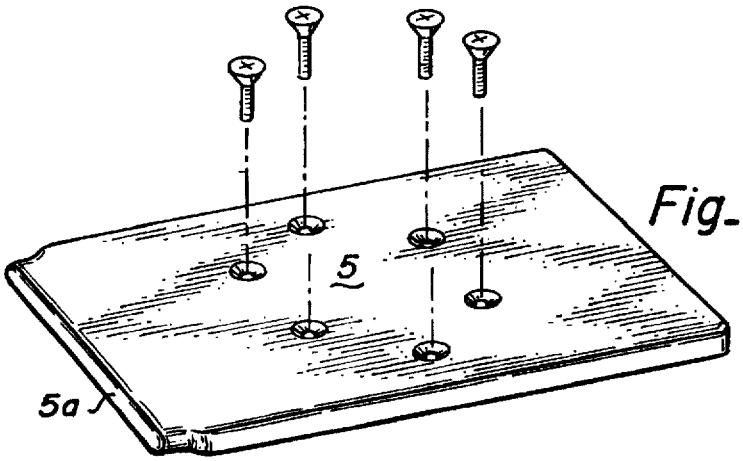
Fig_6

4
5
6
7
9
16
17
18
19
20
21
23
25
26
33

SNOW BOARD BINDING

FIELD OF THE INVENTION

This invention relates to snow board bindings, and, more particularly, to a binding that automatically latches the rider's boots to the board upon stepping into the binding, cannot be unlatched by normal forces exerted on the boot, and releases only by hand.

BACKGROUND

Snow boarding has long been a favored winter sport. In that sport the use a plain board to allow one to slide down a snow covered slope crouched on the board has long been supplanted with more highly crafted boards containing bindings that firmly hold the rider's booted feet on the board. The rider's boots are strapped to the upper surface of the board with the forward foot being at one angle to the longitudnal axis of the snow board and the rearward foot being placed at another angle or substantially perpendicular to that axis. The bindings maintain those foot orientations.

Some snow boarding enthusiasts hold the belief that the bindings should automatically release the boots in the event the rider takes a spill, much like exists in ski bindings. Others, however, including the present applicant, believe that the rider's feet should remain attached to the board even when the rider takes a spill. In skiing the rider's feet are placed on two different boards. In taking a spill, the rider's legs can become oriented in different directions and create great mechanical stress on the legs as might lead to a broken leg. A spill during skiing could thus easily cause a leg injury, if the ski bindings did not automatically release the boots. However, in snow boarding, unlike skiing, the rider's feet are attached to a single board, and leg injuries of the type experienced in skiing should not occur in a spill solely as consequence that attachment. The snow board rider is thus able to upright oneself and continue with the ride more quickly, without the need to reattach one's boots to the snow board.

The foregoing diversity in thought is reflected in the patent literature. U.S. Pat. No. RE 33,544 reissued Feb. 26, 1991 to Dennis and U.S. Pat. No. 5,035,443 granted Jul. 30, 1991 illustrates snow board bindings that, based on the former thinking, are automatically releasible, while U.S. Pat. No. 4,973,073 granted Nov. 27, 1990 to Rains et al and U.S. Pat. No. 5,299,823, granted Apr. 5, 1994 to Glaser exhibit snow board bindings, that, like the present invention, are constructed along the lines of the latter thinking.

The foregoing systems and snow bindings in general are characterised by a latching system that captures and holds the boot to the snow board. Typically, the boot comprises a standard one that is modified to include a plate or other device that is attached externally; and the latch captures that plate. That modification allows one to separately purchase the boot of choice and allows the binding manufacuturer to avoid the need to also build boots.

Existing snow board bindings have not proved satisfactory in applicant's view. One of the latter types is the CLICKER bindings marketed by the K2 company. Like the present invention, that binding requires unlatching by hand. In that binding system, the boot is formed with a specially molded sole that contains a metal piece on the sole bottom. The metal piece attaches to the binding mechanism, which resembles a bicycle shoe lock found on a bicycle pedal.

The CLICKER binding places the rider at a higher than normal height above the snow board. It is as if one is standing on a pedestal. To applicant such an elevated position gives the rider an uncomfortable feeling. As an advantage the present invention allows the sole and heel of the boot to at least touch the snowboard's surface. Further, it is possible for snow to get into a hole in the bottom of the boot, which blocks the metal piece from attaching into the binding.

The SWITCH binding, made in San Francisco, is another. It can jamb onto the boot and not let go. However, applicant believes that binding could become disengaged during use. Moreover, snow can get under the latch, making operation difficult.

As an advantage, with the present invention the rider easily steps into and engages the boot on the snowboard and the binding is made without the aid of straps and without requiring the user to sit in the cold snow. It is also easy to release the boots from the binding. When engaged, the boot essentially rests on the snowboard and not up on a platform as with the CLICKER binding. That gives the user a more secure feeling in the binding and a better feel of the snowboard.

An object of the invention therefore is to provide a new snowboard binding that provides the rider a comfortable ride; to provide a binding that is easy to install and service, that requires unlatching by hand, and that is easily adjusted to accomodate persons of different weight and strength; and which can accomodate to snow boots, hard or soft, of different boot makers. An additional object of the invention is to provide a snow board binding which resists clogging by snow.

SUMMARY OF THE INVENTION

In accordance with the foregoing objects, the novel snow board binding provides a means to automatically latch the riders boots to the snow board when the rider steps into the binding and can be operated under all snow conditions. It allows the soles of the riders boots to abut the surface of the snow board. The boots contain a laterally projecting boot plate that engages the binding. The binding cannot release unless the rider unlatches the binding by hand.

The binding contains a pocket at one end for pivotally anchoring one end of the boot plate, while allowing the other boot plate end to be pivoted into engagement with the latches acutator arm. The actuator arm pivots in response, pivots a mechanically coupled keeper arm into a position overlying that end of the boot plate and pivots a latch arm to a latched position. The latch arm contains a spring mechanism that holds the keeper arm in place barring withdrawl of the boot plate when the latch arm is in the latched position. By applying pressure to the end of the latch arm, the spring mechanism releases and allows the latch arm and keeper arm to pivot out of the way to release the boot.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

BRIEF DESCRIPTION OF THE DRAWINGS

In the Drawings:

FIG. 1 is a perspective of a snow board containing an embodiment of the novel binding system;

FIG. 2 is a perspective of one embodiment of a binding used in the system of FIG. 1, illustrated unlatched;

FIG. 3 is a perspective view of FIG. 2, rotated counter clockwise by ninety degrees;

FIG. 4 is a perspective bottom view of the binding of FIG. 2, with an element repositioned as occurs in use;

FIG. 5 is an exploded view of the embodiment of FIG. 2;

FIG. 6 illustrates in perspective a boot plate element used with the binding of FIGS. 2–5;

FIG. 7 illustrates a modified boot, drawn to reduced scale, for use with the binding of FIG. 2;

DESCRIPTION OF THE PREFERRED EMBODIMENTS

Figure 8A:
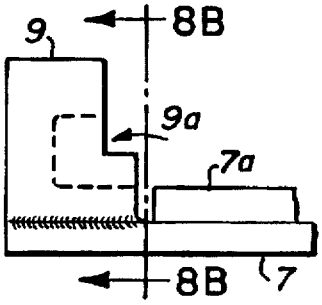
FIGS. 8A and 8B illustrate a side view and a front view of the socket element of the binding of FIGS. 2–4.

Reference is made to the embodiment of the invention illustrated in FIG. 1, which shows the binding system as used by a rider. As there shown forward and rearward snow board bindings 3 are mounted to a snow board 4 at respective forward and rear locations thereon. A rider's boots 6 are fastened by the bindings, illustrated as latched, to the snow board. In practice, a rider, not illustrated is wearing boots 6 and stands on the snow board with the rider's leg posture being governed in part by the orientation of the boots. When the rider is using a standard boot, a rectangular shaped boot plate 5, suitably sized to fit the binding, is permanently attached to the bottom of each boot, suitably with bolts, such as illustrated in FIG. 7, later herein described. Binding 3 captures and holds that boot plate, hence the boot, and the riders foot.

The bindings are oriented at two different angles relative to the longitudnal axis of the snow board, illustrated as alpha and beta, and define the angular orientation of the attached boots. Those angles are chosen to permit the rider to adopt a comfortable riding crouch or stance on the snow board. To accomodate the preferences of individual riders, those orientation angles are individually adjustable.

Essentially the rider steps into the bindings one foot at a time, tilting his boot one way to anchor an end of the boot plate and then pivots the other end down. The binding associated with that boot automatically locks or latches the boots in place. It is appreciated that the overall configuration of the snowboard and boots and the use of the snow board is previously known, except for the details of the bindings, and the improved configuration that results from the incorporation of that new binding. Further, it is noted that the forward binding and the reward binding 3 are identical in structure. Hence only one of those bindings need be described in detail.

The construction of the bindings 3 is presented in greater detail commencing with the perspective view of FIGS. 2 and 3, the bottom view of FIG. 4 and the partially exploded view of FIG. 5 to which reference may be simultaneously made. Although FIG. 1, showed the bindings in a latched condition, in FIGS. 2 and 3 the binding is shown in an unlatched condition.

A base plate 7, having a generally rectangular shaped surface, contains a boot plate socket 9 at one end and a pair of upstanding arms or walls 11 and 13, spaced apart on opposite sides of the base plate, at the base plate's opposite end. Those walls support a latch mechanism, generally represented at 15, containing a pivotally mounted latch arm 17 mounted to a fixed shaft or, as variously termed, axle 21, which serves as the pivot. Being unlatched, the latch arm lies horizontal in this figure, whereas in FIG. 1, with the binding latched, and in FIG. 4 that arm is upright.

For adjustable mounting to the snow board, base plate 7 includes a short cylindrical well 8, best illustrated in FIGS. 4 and 5, recessed from the upper surface of the base plate and a clamping disk 10 is seated within that opening. As shown in FIG. 5, well 8 includes a rim portion 8*b*. Disk 10 seats on that rim portion. As shown in the partially cut away in FIG. 5, the disk includes a cylindrical portion that extends into the circular opening, and an annulus that sits atop rim portion 8*b*. To attach the base plate to the snow board, bolts 12 are inserted through each of four openings in disk 10 and the well and engage one-sided nuts, not illustrated, affixed to the snow board. The bolts are tighted, and the disk thereby clamps base plate 7 to the snow board in the appropriate angular orientation relative to the snow board's longitudnal axis. As is apparent that angular orientation is easily changed by loosening the bolts and rotating the base plate about the axis of disk 10 to the appropriate angle, while the latter of remains fixed in position, and retightening the bolts.

It may be noted that snow board manufacturers include a series of conventional one-sided nuts integrally within the snow board to allow for attachment of bindings, such as the present invention. The invention takes advantage of that accomodation.

FIG. 4 illustrates a bottom perspective view of the binding of FIGS. 2 and 3, with the latch arm 17 raised to the latched position, but without the boot plate 5. As illustrated, the side support walls 11 and 13 extend slightly laterally from the sides of the general rectangular outline of the base plate 7 and are formed by welding short metal pieces to the rectangular plate. In other embodiments they may be otherwise formed directly by conventional casting technique or by hot metal working of a stamped piece. A pair of ridge aligning blocks 16 are located below axle 21 adjacent each side of latch arm 17. The alignment blocks serve as a stop to the end of boot plate 5 preventing the boot plate from moving laterally, to one side or another on the base plate, after the boot plate is latched in place. In this embodiment those blocks are fastened to the base plate by four set screws 14. In other embodiments blocks 16 may be formed integrally with the base plate.

The front edge of alignment blocks 16, that is, the edge face facing the edge of the boot plate, is slighly downwardly sloped or tapered, at angle of ten to fifteen degrees from the vertical. This taper assists the downward pivot of the boot plate's end, later herein described in the discussion of operation, helping to guide the boot plate into position, yet allowing the boot plate to be snuggly seated when fully latched in position.

Base plate 7 contains two short flat metal pieces 7*a* and 7*b*, one located on each side of disk 10, and each containing a concavely shaped almost semicircular shaped end. Those two plates are adhesively attached to an underlying metal plate to form a unitary assembly for the base plate. Those pieces serve as shims, ensuring that the top surface of the base plate lies above the top surface of disk 10. This allows the boot plate 5 to rest securely against the base plate without interference being caused by the clamping disk and attachment bolts. It is recognized that the foregoing is necessary since the embodiment is fabricated from commerically available standard metal strips of standard thickness. However, in mass production, the base plate would preferably be formed of a single piece of metal.

Referring to FIG. 2, latch 15 includes a latch arm 17, tension adjustment screw 19, axle 21, which defines the pivot axis for the latch arm, a first ledge or latch actuator arm 23 and a second ledge or latch keeper arm 25. The latch actuator arm and latch keeper arm are angularly spaced about the axis of axle 21, suitably by ninety degrees. Additional elements of that latch are better illustrated in the exploded view of FIG. 5, to which reference is made.

Latch arm 17 contains a piston 18, having a stem, and a compression spring 20 which are held in place within an internal cylindrical shaped passage 22, by tension adjustment screw 19. The adjustment screw contains a plug end 24 and bolt threads on a lenght adjacent its plug end. Tension adjustment screw 19 is threaded into place in the lever arm by engagement with mating threads formed on the internal walls at the end of the cylindrical passage 22. The plug end contacts spring 20 and compresses the spring slightly. A second passage 26 in the latch arm is provided for axle 21, that pivotally mounts the latch arm to the base plate. That passage runs orthogonal to passage 22 and both passages intersect within the body of the latch arm.

Figures 11A, 11B, 11C, 12A, 12B, 12C:
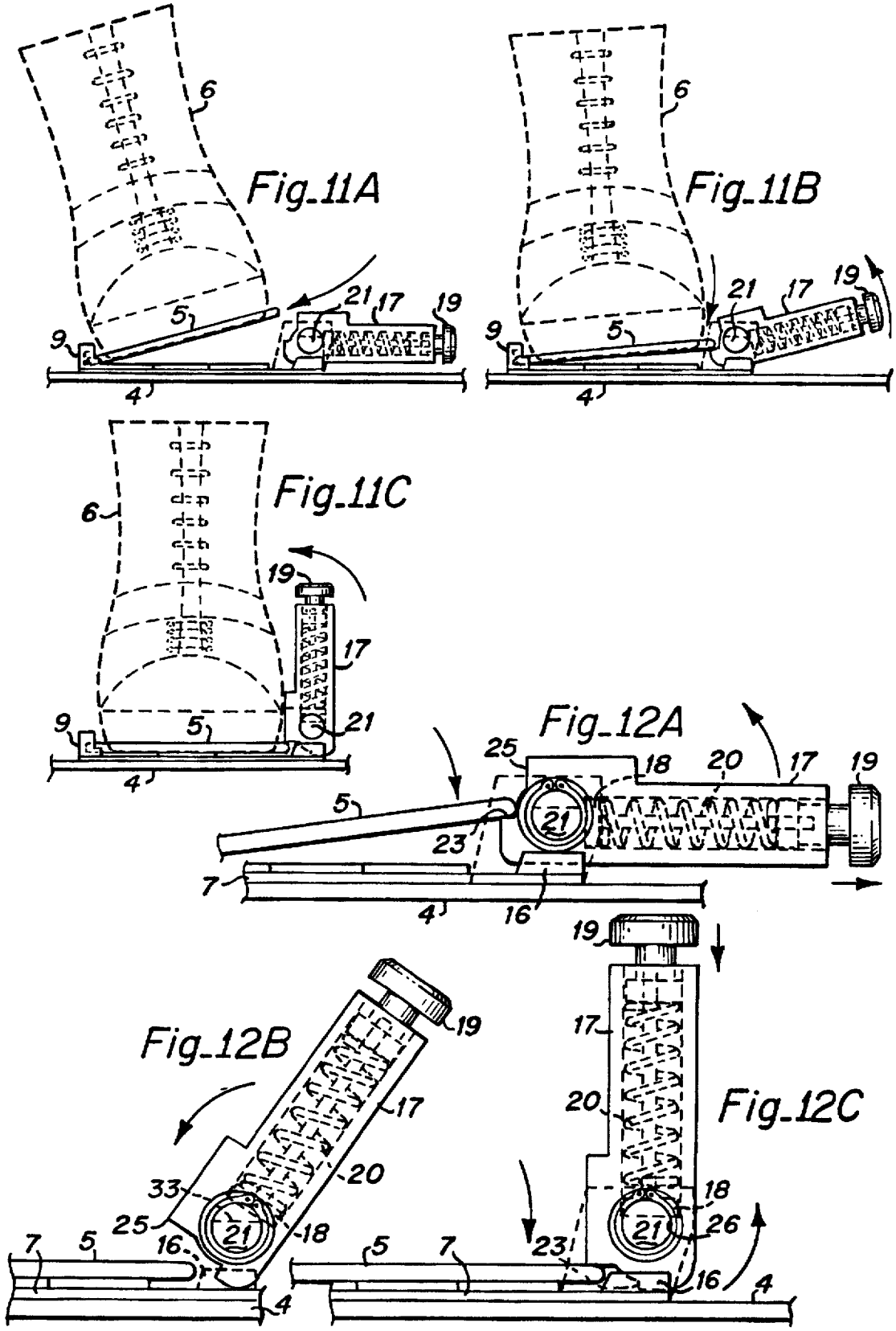
FIGS. 11A, 11B and 11C pictorially illustrate the steps in inserting the modified snow boot of FIG. 7 into the binding of FIG. 2.
FIGS. 12A, 12B and 12C illustrate operation of the latch mechanism, illustrating, respectively, a partial side view drawn of the latch element in the embodiment of FIG. 2 shown unlatched, drawn to enlarged scale; a partial view of that element in a transition position; and a partial view of those elements in the latched position.

As best illustrated in FIG. 12A, to which brief reference may be made, cylindrical passage 22 extends along the longitudnal axis of latch arm 17 and opens through a cylindrical wall of another passage 26 that is located at the bottom or proximal end of latch arm 17. That allows piston 18 to be pressed against a cam surface on axle 21.

Returning to FIG. 5, one end of axle 21 contains a key 27, oblong in shape, protruding from the end. The axle's opposite end is cylindrical. The key fits within a mating key slot 29 formed in axle support wall 11. The axle 21 includes a cam portion having a cylindrical portion 31 and a flat portion 33, which interacts with the spring driven piston 18 to form the latch mechanism. The mating key slot 29 serves to lock the axle from rotation, and also fixes the angular orientation of the flat portion 33 of the axle's cam surface. The axle also contains three spaced grooves, each circumscribe the axle surface, and respective retaining spring clips 36, 37 and 38 are fitted within those respective grooves. Spring clips 37 and 38 prevent the latch arm from moving axially along axle 21, while spring clip 36 prevents axle 21 from moving out of the support arms. A pair of washers 34 are mounted on the axle between the sides of the latch arm and respective spring clips 37 and 38.

As is apparent from FIG. 5, the foregoing elements are easily assembled. Holding the latch arm 17 with its axle passage 26 aligned with opening 28 in wall 13, a washer 34 is insered over the axle and the axle is inserted through wall opening 28, through latch arm passage 26, the second washer 34 is placed over the axle and the axle is advanced until key 27 engages the mating slot 29 in wall 11. The key and slot arrangement ensures that axle 21 cannot rotate. Spring clip 36 is inserted in place, ensuring that axle 21 cannot be withdrawn from its support in the key slot. The washers are moved along the axle and against the latch arm. Then clips 37 and 38 are inserted into place holding wahsers 34 against the side of the latch arm 17.

By design the angular orientation of the key and slot is such that, as assembled, the flat 33 on the axle is oriented horizontal, such as illustrated in FIG. 12A; that is, parallel to the horizontal plane defined by the upper surface of base plate 7. The piston 18 and compression spring 20 are then inserted into the latching arm and the adjustment screw 19 is then threaded into place, closing the end of the cylindrical passage. The adjusting screw is tightened to ensure that the enclosed spring is in compression so that the spring firmly presses the piston against the cam surface of axle 21. Preferably the foregoing elements within the latch arm and the cam surfaces are lubricated with a suitable grease, not illustrated, to avoid binding between the mechanism's elements. Washers 34 are preferably lubricated as well.

As best viewed in FIG. 4, a rectangular cut out portion 30 or U shaped end indentation, as variously termed, is provided at the right hand end of the base plate 7 to define an open end region to the plate. That open end region provides clearance for the bottom end of the latch arm 17 and actuator arm 23 when the latch arm is rotated to the upright or vertical latched position and the actuator arm 23, carried on the latch arm, swings into a vertical orientation.

Referring to FIG. 6, boot plate 5, shown in an inverted position, is essentially rectangular in shape and contains an end that is champhered or assymetrically reduced in section along one end 5A so as to properly fit within socket 9. As shown to reduced scale and inverted position in FIG. 7, boot plate 5 is permanently attached to the boot's bottom or sole, by bolts or other conventional fasteners, to form a rigid unitary assembly. That plate is greater in length than the boot's width so that end portions project from the boot's side, essentially forming a pair of rigid metal wings on the boot that are rigidly aligned with one another. As fastened, a portion of the plate projects laterally of the sole to the right and another portion projects outwardly to the left.

Figure 8B:
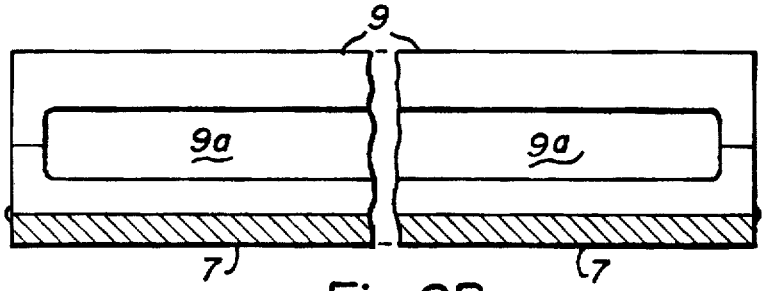
Figure 9:
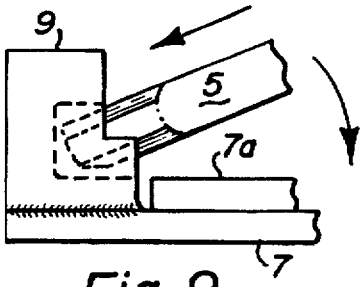
FIGS. 9 and 10 are partial pictorial views used to illustrate the relationship of the socket of FIGS. 8A and 8B with the boot plate element shown in FIGS. 6 and 7.
Figure 10:
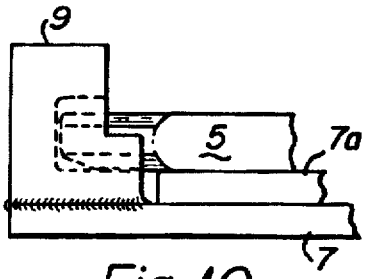

FIGS. 8A and 8B better illustrates in partial section and front view, respectively, the construction of pocket or socket 9. As shown the socket 9 is formed upstanding from the upper surface of base plate 7 and includes a pocket 9A recessed from the front surface. As illustrated in the partial pictorial views of FIGS. 9 and 10, the pocket is sized to receive one end of boot plate 5, attached to the user's boot. The socket prevents further movement of the boot plate along the longitudnal axis of the base plate 7, to the left in FIG. 5; and prevents upward movement of that end. The boot plate serves also a pivot for the boot plate, allowing the boot plate to swing downwardly from that pivot point toward base plate 7 and upwardly. That pivoting action is used, as next described in connection with FIGS. 11A–11C, hereafter. The roof of the pocket cavity is shorter than the floor, together resembling the letter "J" laying on its longer side. That shape enhances the ability of the boot plate to be initially anchored in the pocket and swung down.

As illustrated by FIG. 11A, the user mounts the binding by first orienting his boot to insert and anchor the reduced thickness end edge 5A of the boot plate within socket 9, moving the rider's foot to the rider's right in the figure. The rider then steps down, pivoting the other end of the boot plate down to engage the actuator arm 23, and pressing down, FIG. 11B, thereby pivots latch arm 17 upwardly, counter clockwise in the figure, from its horizontal position. In response, latch 15 automatically latches the boot in place between the latch arm and the socket with the latch arm oriented upright as illustrated in FIG. 11C.

The latch mechanism's operation is separately viewed in FIGS. 12A, 12B and 12C. The partial view of FIG. 12A, drawn in a larger scale, shows the latch arm in unlatched position; that of FIG. 12B, shows the latch arm in an intermediate transition postion; and the corresponding partial view of FIG. 12C shows the latch arm in the latched position.

In unlatched position, the latch arm lies essentially horizontal, spring 20 presses piston 18 against the cylindrical cam surface 31 of axle 21, and the planar surface forming latch actuator arm 23 is also oriented horizontal and it lies in the arcuate path of travel of the edge of boot plate 5. When the rider swings the end of boot plate 5 down and presses the boot plate against actuator arm 23, such as when the rider completes his step into the binding, the mechanical moment produced about the axis of axle 21 by that force is sufficient to overcome the surface friction between piston 18 and the cylindrical cam surface 31. This surface friction is small, since the piston surface is tangential to the round on the cam and only a small portion of the flat face of piston 20 contacts that cylindrical surface 31.

As the end of boot plate 5 is pressed further and continues its arcuate movement, pivoting about socket 9, it pivots the actuator arm 23, counter clockwise in the figure, and, thereby, also pivots the associated keeper arm 25 and latch arm 17. Latch arm 17 thereby is swung counter clockwise about the axle 21. The internal piston 18 slides along cylindrical surface 31 of the cam.

As such forced rotation of the latch arm continues, the piston is moved over the edge of the junction between the rounded portion and the flat 33 on the cam, such as illustrated in FIG. 12B, with the latch arm positioned at about a forty five degree angle to the horizontal. A portion of the piston's face lies over the boundary between round and flat portions of the cam surface and is unsupported. The end of boot plate 5 slides off the end of the actuator arm 23 and continues moving until it comes to rest against base plate 7. The boot plate is not able to fully rotate the actuator arm beyond this point illustrated. However it is found that the latch arm attains a position of unstable equilibrium and instead the force provided by spring 20 on piston 18 is sufficient to cause the latch arm to continue rotation on its own to the upright position at which it achieves a stable position.

The force of expansion in the spring essentially walks the piston over onto the flat cam surface 33, carrying along the latch arm, and in so doing the spring expands slightly and thereby presses the full surface of the piston onto the flat 33, restoring equilibrium. The latch arm achieves an upright vertical position, actuator arm 23 is pivoted into the cut out clearance space 30 and is vertically oriented, and the boot plate 5 is in contact with the base plate 7.

Further, in swinging latch arm 17 to the vertical position, the latch arm's keeper arm 25 changes orientation from the vertical orientation illustrated in FIG. 12A to the horizontal position overlying the distal edge of the boot plate 5, illustrated in FIG. 12C, showing the latch arm latched. In the latched position, any upward movement of the boot plate edge is effectively blocked by keeper arm 25. At the other end vertical movement of the boot plate is blocked by the upper wall or ceiling, as variously termed, of socket 9.

In this latched position it is not possible for the rider to release the boot plate or disengage latch arm by merely pulling the boot against keeper ledge 25. Any normal range of upward force on the bootplate's end is insufficient to move piston 18 off the flat 33 and onto the rounded portion 31 against the force exerted by compression spring 20. The latch may be reset only by hand, by applying pressure to the end of the latch arm, forcing the latch arm to move clockwise. This moves the piston off the flat, recompressing spring 20, and onto the cylindrical surface 33 of the cam, whereupon the latch arm is easily moved, without significant resistance, to the horizontal unlatched position. This is true even though the same force is exerted by foot and by hand, since the latch arm provides a significantly greater lever arm than the keeper arm and hence produces a greater mechanical moment.

As shown, the distance between the keeper arm 25 and the axis of axle 21 is quite short, as allows only a relatively small moment to be produced to rotate the latch arm clockwise, even though the force exerted by the boot plate's edge is large. In contrast to that mechanical moment, the distance between the far or distal end of latch arm 17 and the axis of of axle 21 is relatively great, enabling one to produce a greater turning moment with a relatively smaller force applied at the end of the latch arm. As example, in a practical embodiment, for a given spring tension, a fifty pound pull was required on the end of the boot plate to rotate the latch arm out of the latched position, a force level that is unlikely for a person of normal weight upon spilling, whereas only about five pounds of push by hand was required to do so.

Referring again to FIG. 7, an important advantage to the foregoing invention, is that the rider's boots may be placed in contact with the snow board surface through appropriate dimensioning of the thickness of the boot plate and/or base plate elements. In many standard brands of snow boots being marketed, such as the FLEXIBLE brand boots, an arch space is found between the boot's thick heel and sole; and that arch space is elevated (or recessed) from the outer surface of the recited boot elements. Boot plate 5 is sized to be of a width that fits within that arch space, allowing a portion of the surface of the boot and heel to protrude below the boot plate a predetermined amount. Further, the binding's base plate 7 is sized to be of a thickness that is about equal to that predetermined amount. As a consequence, when the boot is latched in the binding, at least some portion of the boot and heel is able to contact the snow board's surface.

The base plate and related elements are preferably formed of strong rigid metal such as high quality aluminum, suitably aircraft grade, and steel. In a practical embodiment of the invention, the actuator arm arm is 7/32 nds of an inch in length and there is 23/32nds of an inch between that arm's end and the axis of axle 21. The keeper arm was 15/32nds of an inch in length. The spring length was chosen to be 2.125 inches uncompressed and, fully compressed, was 1.5 inches in length, requiring a compressive force of 250 pounds. This determines a linear spring constant of 400 pound inches. The circular portion 33 of the cam is about 0.710 inches in diameter and the flat portion 31 of that cam surface is recessed from the outer periphery by about 0.25 inches. Assuming the spring is slightly compressed, it may be shown that to further compress the spring by about 0.25 inches requires about fifty additional pounds. The force required to reset the latch by hand is only about one-tenth or less of the force that is required to do so by pulling upon the boot.

The length of the binding is about 6.5 inches, the width a little greater that 3.25 inches, and the base plate 7 thickness, including the shims, about 1/8th inch. Socket 9 is about 3.125 inches long, and contains a pocket about 3 inches long, 1/4th inch deep and a heighth about 3/8th inch. The sockets bottom wall is about 1/2 inch deep and its top wall about 3/8th inch deep, making the latter about 1/8th inch shorter in depth.

The foregoing binding is seen as a simple and rugged structure containing a small number of elements and appears relatively easy to manufacture, maintain and operate and is expected to be capable of withstanding hard use. It allows the rider's boot sole to be in contact with the surface of the snow board, not elevated above it, ensuring a comfortable natural feeling in use. The inner workings of the latching mechanism, such as the spring, piston and cam are enclosed and greased, and are protected from the elements, such as snow, thereby preventing snow from jambing operation.

Figure 13A:
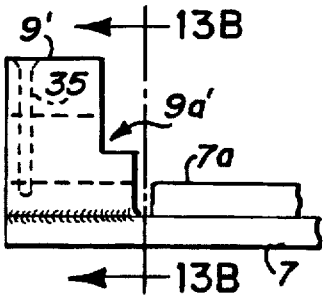
FIGS. 13A and 13B illustrate side and front views of an alternative construction for the socket element of FIGS. 8A and 8B.
Figure 13B:
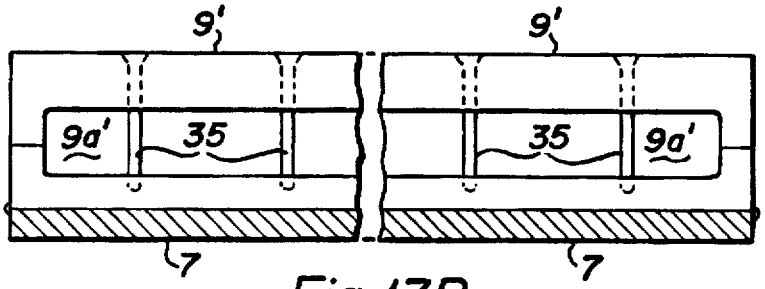

Various modifications to the foregoing elements become apparent. As one example, in another embodiment of the invention, the rear of the socket 9 may contain a passage extending entirely therethrough to the other side, such as shown in the partial side view of socket 9' in FIG. 13. In such alternative, metal pins 35 are inserted across the rear of the opening to serve as a stop or barrier for end of the boot plate. The passage allows any ice or snow that may have accumulated in the socket to be more easily removed by forcing same through the open passage.

It is believed that the foregoing description of the preferred embodiments of the invention is sufficient in detail to enable one skilled in the art to make and use the invention. However, it is expressly understood that the detail of the elements presented for the foregoing purposes is not intended to limit the scope of the invention, in as much as equivalents to those elements and other modifications thereof, all of which come within the scope of the invention, will become apparent to those skilled in the art upon reading this specification. Thus the invention is to be broadly construed within the full scope of the appended claims.

What is claimed is:

1. A snow board binding comprising:

a boot plate for attachment to the bottom of a boot, said boot plate having first and second ends projecting laterally from said boot;

socket means for receiving said first end of said boot plate, said socket means providing a pivot point for said boot plate; wherein said second end of said boot plate defines an arcuate path of travel about said socket means;

latch means for receiving said second end of said boot plate and automatically locking said second end of said boot plate against pivotal movement, wherein said boot plate is locked in position between said latch means and said socket means; said latch means being spaced from said socket means and being located in said arcuate path of travel of said boot plate's second end;

said latch means including:

a latch arm;

a latch arm pivot axis;

said latch arm having first and second ends and being of a first predetermined length; said latch arm being pivotally mounted to said pivot axis to permit pivotal movement of said latch arm, said latch arm being disposed in a first angular position about said pivot axis when said latch means is unlatched and being disposed in a second angular position about said pivot axis when said latch means is latched;

said latch arm including an actuator arm, and a keeper arm;

said actuator and keeper arms being fixed in position relative to one another and mechanically coupled to said latch arm for pivotal movement therewith, with said keeper arm being angularly spaced in position about said pivot axis from said actuator arm;

said keeper arm being of a second predetermined length, substantially shorter than said first predetermined length of said latch arm;

said actuator arm being located in said arcuate path of travel of said second end of said boot plate when said latch arm is disposed in said first angular position, wherein, responsive t2 arcuate movement of said second end of said boot plate in a first direction, said second end of said boot plate engages said actuator arm and forces said actuator arm to pivot said latch arm toward said second angular position, and said keeper arm toward a position overlying said second end of said boot plate;

said latch means further including:

spring powered means for automatically pivoting said latch arm to said second angular position, responsive to said actuator arm partially pivoting said latch arm toward said second angular position, whereby said said keeper arm is pivoted to a position overlying said second end of said boot plate to block said boot plate's second end from pivotal movement, and for permitting said keeper arm to pivot from a position overlying said second end of said boot plate to disengage said latch means and unlock said boot plate, responsive to application of a predetermined level of force to said second end of said latch arm, and for preventing said keeper arm from pivoting from said position overlying said second end of said boot plate, in response to application of said predetermined level of force on said second end of said boot plate.

2. The invention as defined in claim 1, further comprising:

base plate means for attachement to a snow board; and wherein said socket means is supported at a first end of said base plate means and wherein said latch means is supported at an opposed end of said base plate means.

3. The invention as defined in claim 1, wherein said pivot axis comprises a non-rotatable shaft;

wherein said latch arm includes a longitudnally extending passage and a laterally extending passage, oriented orthogonal to said longitudnally extending passage;

said laterally extending passage being located at one end of said latch arm, and said longitudnally extending passage extending through a side wall of said laterally extending passage;

wherein said non-rotatable shaft extends through said laterally extending passage; and wherein said spring powered means comprises:

a compression spring, said compression spring being disposed in said longitudnally extending passage;

a cam, said cam being fixed to said shaft and being located within said laterally extending passage at an axial position therealong at which said longitudnally extending passage intersects said laterally extending passage;

a piston, said piston being disposed in said longitudnally extending passage and being driven by said compression spring against said cam.

4. The invention as defined in claim 3, wherein said cam includes a cylindrical surface portion and a flat surface portion.

5. The invention as defined in claim 4, wherein said piston is disposed against said flat surface portion of said cam when said keeper arm is positioned overlying said second end of said boot plate and wherein said piston is disposed against said cylindrical surface portion when said actuator arm is positioned is said arcuate path of travel of said second boot plate end.

6. The invention as defined in claim 5, further comprising: base plate means for attachement to a snow board; and wherein said socket means is supported at a first end of said base plate means; and wherein said latch means is supported at an opposed end of said base plate means.

7. The invention as defined in claim 6, wherein said base plate means includes first and second support arms upstanding on said base plate, said support arms being laterally displaced from one another; said first support arm for supporting one end of said non-rotational shaft and said second support arm for supporting another end of said non-rotational shaft.

8. The invention as defined in claim 7, wherein said non-rotational shaft includes a key means at said one end; and wherein said first support arm includes a slot means, said slot means for engaging said key means to prevent said non-rotational shaft from rotational movement.

9. The invention as defined in claim 8, wherein said base plate means includes a circular opening; and further comprising:

clamping disk means for covering said circular opening and mounting said base plate means to a snow board.

10. The invention as defined in claim 7, wherein said actuator arm is oriented perpendicular to said keeper arm.

11. The invention as defined in claim 7, further comprising plug means for closing an end of said longitudnally exending passage, said plug means containing screw threads for engaging threads in said latch arm's longitudnally extending passage, whereby the depth of said plug means within said longitudnally extending passage is adjustable to adjust the degree of compression of said compressed spring.

12. The invention as defined in claim 7, wherein said socket comprises: a chamber having top wall and a floor, said top wall being shorter in length than said floor.

13. Apparatus for attaching a boot to a snow board, said boot including a sole and metal side wings projecting sideways from the right and left sides of said sole, said metal side wings being rigid and being rigidly aligned with each other, comprising:

a base plate for attachment to a snow board, said base plate having first and second ends;

a pocket located at one end of said base plate for receiving an end of one of said metal wings and for providing a pivot point for downward swinging movement of a remaining one of said metal wings; said pocket permitting said metal wings to pivot downwardly about said first end of said boot plane toward said snow board wherein an outer end of said remaining one of said metal wings defines an arcuate path of travel;

a latch located at the other end of said base plate for receiving said outer end of said remaining one of said metal wings and automatically locking said metal wings in position between said latch and said pocket to prevent withdrawl of said metal wings;

said latch including:

a latch arm;

a latch arm pivot axis;

said latch arm having first and second ends and being of a first predetermined length; said latch arm being mounted at said first end to said latch arm pivot axis to permit pivotable movement of said latch arm;

said latch arm further carrying an actuator arm and a keeper arm;

said keeper arm being of a second predetermined length, substantially shorter than said first predetermined length, and said keeper arm being angularly spaced about said pivot axis from said actuator arm;

said actuator arm being located in said arcuate path of travel of said outer end of said remaining one of said metal wings, whereby said outer end engages said actuator arm and forces said actuator arm to pivot said latch arm, including said keeper arm, responsive to swinging movement of said metal wings in a first direction toward said base plate, to thereby pivot said keeper arm in a first direction toward a position overlying said outer end of said remaining one of said metal wings;

said latch further including spring means for preventing said outer end of said remaining one of said metal wings from pivoting said keeper arm in a second direction opposite to said first direction; and said spring means permitting said keeper arm to pivot in said second direction responsive to application of manual force on said second end of said latch arm to disengage said latch and unlock said metal wings.

14. The invention as defined in claim 13, wherein said latch arm pivot axis comprises a non-rotatable shaft;

wherein said latch arm includes a longitudnally extending passage and a laterally extending passage, oriented orthogonal to said longitudnally extending passage;

said laterally extending passage being located at one end of said latch arm, and said longitudnally extending passage extending through a side wall of said laterally extending passage;

wherein said non-rotatable shaft extends through said laterally extending passage; and wherein said spring means comprises:

a compression spring, said compression spring being disposed in said longitudnally extending passage;

a cam, said cam being fixed to said shaft and being located within said laterally extending passage at an axial position therealong at which said longitudnally extending passage intersects said laterally extending passage;

a piston, said piston being disposed in said longitudnally extending passage and being driven by said compression spring against said cam.

15. The invention as defined in claim 14, wherein said cam includes a cylindrical surface portion and a flat surface portion.

16. The invention as defined in claim 15, wherein said piston is disposed against said flat surface portion of said cam when said keeper arm is positioned overlying said outer end of said remaining one of said metal wings; and wherein said piston is disposed against said cylindrical surface portion when said actuator arm is positioned is said arcuate path of travel of said outer end of said remaining one of said metal wings.

17. Apparatus for binding a snowboard rider's foot to a snowboard, said snow board having a riding surface and a principal snowboard axis;

a boot for the rider's foot;

said boot including a sole portion, a heel portion, a bridging portion between said sole and heel portions and right and left lateral sides;

said boot including a boot plate mounted to said boot within said bridging portion of said boot; said boot plate having first and second ends; said boot plate's first and second ends projecting outwardly from said boot's left and right lateral sides, respectively;

a binding mounted to said riding surface of said snow board for seating said boot plate and interlockingly engaging said first and second boot plate ends;

said binding including:

a base plate;

a boot plate socket located at one end of said base plate to hold a first end of said boot plate to said bottom plate while permitting pivotal movement of said boot plate, whereby said boot plate's second end defines an arcuate path of travel;

latching means for latching the remaining boot plate end to said bottom plate; said latching means comprising: a latch arm;

said latch arm having first and second ends along a first latch arm axis; said latch arm including (a) a longitudnally extending cylindrical passage, extending along said latch arm axis the length of said latch arm internal of said latch arm, and (b) a laterally extending cylindrical passage, oriented orthogonal to said longitudnally extending passage;

said laterally extending passage being located proximate one end of said latch arm, and said longitudnally extending passage extending through a side wall of said laterally extending passage;

an axle for mounting said latch arm for pivotal movement about said axle between a horizontal unlatched position and a vertical latched position;

said axle extending through said laterally extending cylindrical passage, whereby said latch arm may pivot about said axle;

first and second axle support arms for supporting said axle in fixed non-rotational position; said axle support arms being located at an end of said base plate opposed to said boot plate socket and being spaced laterally on said base plate;

said first axle support arm including a cylindrical opening for receiving said shaft;

said second axle support arm including a slot for receiving a key;

said axle including a cam surface located at a predetermined longitudnal position along the axis of said axle and underlying said longitudnally extending passage in said latch arm, said cam surface extending about the circumference of said axle;

said cam surface including (a) a cylindrical surface portion of predetermined radius and (b) a flat portion, said flat portion defining a chord extending between the ends of said cylindrical surface portion;

said flat portion of said cam surface being contiguous with said cylindrical portion and being oriented horizontal; said cylindrical portion extending over a major portion of 360 degrees and said flat portion extending over the remaining portion of said 360 degrees;

said axle including key means at one end of said axle for engagement with said slot in said second axle support arm to support an end of said shaft in stationary non-rotatable position for orienting said flat portion of said cam surface of said axle in the horizontal position;

a piston, said piston having a flat front face and a back face and being located within said cylindrical passage;

a helical compression spring; said compression spring located within said hollow cylindrical passage for producing a force on said back face of said piston;

said piston containing a stem, said stem being attached to said back face of said piston and being located coaxial of said compression spring;

a plug mounted to the distal end of said longitudnal cylindrical passage for closing and end of said longitudnal spring and holding said compression spring in compression, whereby said spring forces said front face of said piston against said cam surface;

said longitudnally extending passage including threads located at said distal end; and wherein said plug contains a mating screw thread for threaded engagement with said threads of said longitudnally extending passage to hold said plug to said cylinder and for adjusting the longitudinal position of an end of said plug along the axis of said longitudnally extending passage and thereby adjust the compression of said compression spring;

said piston being movable in one direction along the axis of said cylinder responsive to expansion of said spring and being movable in the opposite direction along the axis of said cylinder by a force acting on said front face of said piston against the force of said spring to further compress said compression spring;

said flat front face of said piston tangentially engaging said cylindrical surface of said cam when said latch arm is in the horizontal unlatched position and fully engages said flat portion of said cam surface when said latch arm is in the vertical latched position under force exerted by said spring;

said latch arm including a first ledge defining a latch actuator and comprising a fraction of the length of said latch arm;

said first ledge being oriented in a substantially horizontal position and located in said arcuate path of travel of said second end of said boot plate when said latch arm is in the horizontal unlatched position and a substantially vertical position out of said arcuate path of travel when said latch arm is in the vertical latched position;

said latch arm including a second ledge to define a keeper arm;

said second ledge being oriented in a substantially vertical position out of said arcuate path of travel when said latch arm is in the horizontal unlatched position and in a substantially horizontal position within said arcuate path of travel when said latch arm is in the vertical latched position;

said first and second ledges being oriented ninety degrees relative to one another, whereby rotation of said latch arm from the horizontal to a vertical position moves said second ledge from a vertical orientation into a horizontal position overlying said second end of said boot plate;

said base plate including a base opening located underlying said latch arm, whereby at least a portion of said first ledge is received within said base opening when said latch arm is in the vertical latched position;

whereby said second end of said boot plate during movement in said arcuate path of travel engages said first ledge and pivots said first ledge and latch arm about said axle from the unlatched position toward said latched position and said piston at least in part slides off said cylindrical cam portion and, under force of said compression spring, rotates said latch arm fully to the unlatched position whereby said piston fully engages said flat portion of said cam and said second ledge is pivoted into a position overlying said second end of said boot plate; and wherein the force required to be exerted at the distal end of said latch arm to produce the mechanical moment to restore said latch arm to the unlatched position is less than any mechanical moment that can be produced by force applied to said second end of said boot plate against said second ledge;

said boot sole and boot heel overlapping said base plate and being in contact with said riding surface of said snow board, responsive to said binding seating and locking said base plate;

said binding further including:

a clamping disk;

said base plate containing a circular well for receiving said clamping disk; said well being recessed from a top surface of said back plate for receiving said clamping disk; and fastening means for fastening said clamping disk to said snow board to clamp said base plate therebetween; whereby said base plate may be rotated about the axis of said clamping disk and the orientation of said binding relative to the axis of said snowboard is adjustable.

* * * * *

UNITED STATES PATENT AND TRADEMARK OFFICE

CERTIFICATE OF CORRECTION

PATENT NO : 5,713,594

DATED : Feb. 3, 1998

INVENTOR(S) : David Christian Jenni

It is certified that error appears in the above-identified patent and that said Letters Patent is hereby corrected as shown below:

At Column 10, line 7, "t2" should read --to--.

Signed and Sealed this

Twenty-first Day of April, 1998

Bruce Lehman

*Attest:*

BRUCE LEHMAN

*Attesting Officer*

*Commissioner of Patents and Trademarks*